US009502009B1

(12) United States Patent
Anderson

(10) Patent No.: US 9,502,009 B1
(45) Date of Patent: Nov. 22, 2016

(54) TREMOLO BLOCK

(71) Applicant: Edward Anderson, Austin, TX (US)

(72) Inventor: Edward Anderson, Austin, TX (US)

( * ) Notice: Subject to any disclaimer, the term of this patent is extended or adjusted under 35 U.S.C. 154(b) by 0 days.

(21) Appl. No.: 14/799,126

(22) Filed: Jul. 14, 2015

Related U.S. Application Data

(60) Provisional application No. 62/039,726, filed on Aug. 20, 2014.

(51) Int. Cl.
*G10D 3/00* (2006.01)
*G10D 3/14* (2006.01)

(52) U.S. Cl.
CPC ..... *G10D 3/146* (2013.01)

(58) Field of Classification Search
CPC ..... G01D 3/146
USPC ..... 84/313
See application file for complete search history.

(56) References Cited

U.S. PATENT DOCUMENTS

| | | | | |
|---|---|---|---|---|
| 3,248,991 | A | 5/1966 | Cole | |
| 4,171,661 | A | 10/1979 | Rose | |
| 4,572,049 | A | 2/1986 | Tanaka | |
| 4,608,906 | A | 9/1986 | Takabayashi | |
| 4,638,711 | A | 1/1987 | Stroh | |
| 4,677,891 | A | 7/1987 | Gressett | |
| 4,681,011 | A | 7/1987 | Hoshino | |
| 4,768,415 | A | 9/1988 | Gressett | |
| 4,882,967 | A | 11/1989 | Rose | |
| 4,928,564 | A | 5/1990 | Borisoff | |
| 5,413,019 | A | 5/1995 | Blanda | |
| 5,477,764 | A * | 12/1995 | Carrico | G10D 3/12 84/297 R |
| 5,847,297 | A | 12/1998 | Fisher | |
| 6,084,166 | A | 7/2000 | Lee | |
| 6,919,501 | B2 | 7/2005 | Burton | |
| 7,534,955 | B2 * | 5/2009 | Adams | G10D 3/143 84/312 R |
| 7,557,282 | B2 | 7/2009 | Holdway | |
| 8,008,559 | B1 | 8/2011 | Ward | |
| 8,546,670 | B2 | 10/2013 | Finkle | |
| 2004/0094014 | A1 | 5/2004 | Kang | |
| 2013/0019736 | A1 * | 1/2013 | Finkle | G10D 3/00 84/313 |

* cited by examiner

*Primary Examiner* — Jianchun Qin
(74) *Attorney, Agent, or Firm* — CreatiVenture Law; Linda L. Lewis

(57) ABSTRACT

A tremolo bridge having a block plate and a tremolo block, the tremolo block modified with a string cartridge which is modular and interchangeable; the string cartridge has a cartridge body with a string bore and can be used with a tremolo block; or the string cartridge is directly mounted in the stringed instrument without the block; the string cartridge has a string bore with a first end having a boss and a second end having a grip; and in a preferred embodiment the string bore is off-center.

10 Claims, 11 Drawing Sheets

TREMOLO BLOCK

CROSS-REFERENCE TO RELATED APPLICATIONS

This application claims priority from U.S. Provisional Patent Application No. 62/039,726 filed Aug. 20, 2014.

STATEMENT REGARDING FEDERALLY SPONSORED RESEARCH

Not Applicable.

APPENDIX

Not Applicable.

BACKGROUND OF THE INVENTION

Field of the Invention

The present invention relates to an improved tremolo assembly for an electric guitar. The invention is designed to replace existing tremolo designs.

Related Art

Prior art devices have used tremolo arm, which is a lever that is attached to the bridge of an electric guitar to vary the tension in the guitar strings temporarily. Varying the tension allows the player to change pitch and create a "vibrato effect."

Earlier tremolo designs have used a solid block, a tremolo plate or a combination thereof to connect a series of springs to the tremolo structure. The springs are housed within the guitar's body and return the tremolo structure to the normal position after the guitar player releases the tremolo arm.

Examples of known prior art devices are described in the references listed below, which are hereby incorporated by reference. U.S. Pat. No. 8,546,670 discloses a tremolo device having an inertia block mechanism. U.S. Pat. No. 8,008,559 modified the shape of a tremolo block to increase the mass of the lower portion of the block improve vibrato. U.S. Pat. No. 5,847,297 discloses a tremolo device with adjustable saddle screws. None of the above patents disclose the use of a string cartridge in its tremolo devices.

SUMMARY OF THE INVENTION

The present invention is directed to a tremolo bridge having a block plate and a tremolo block. The tremolo block is modified with string cartridges which are modular and interchangeable. The string cartridge comprises a cartridge body with a string bore therethrough. In a preferred embodiment, the string cartridge is used with a tremolo block, but in another preferred embodiment, the string cartridge is directly mounted in the stringed instrument without the tremolo block. The string cartridge has a string bore with a first end having a boss and a second end having a grip. In a preferred embodiment, the string bore is off-center to the longitudinal axis of the cartridge body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
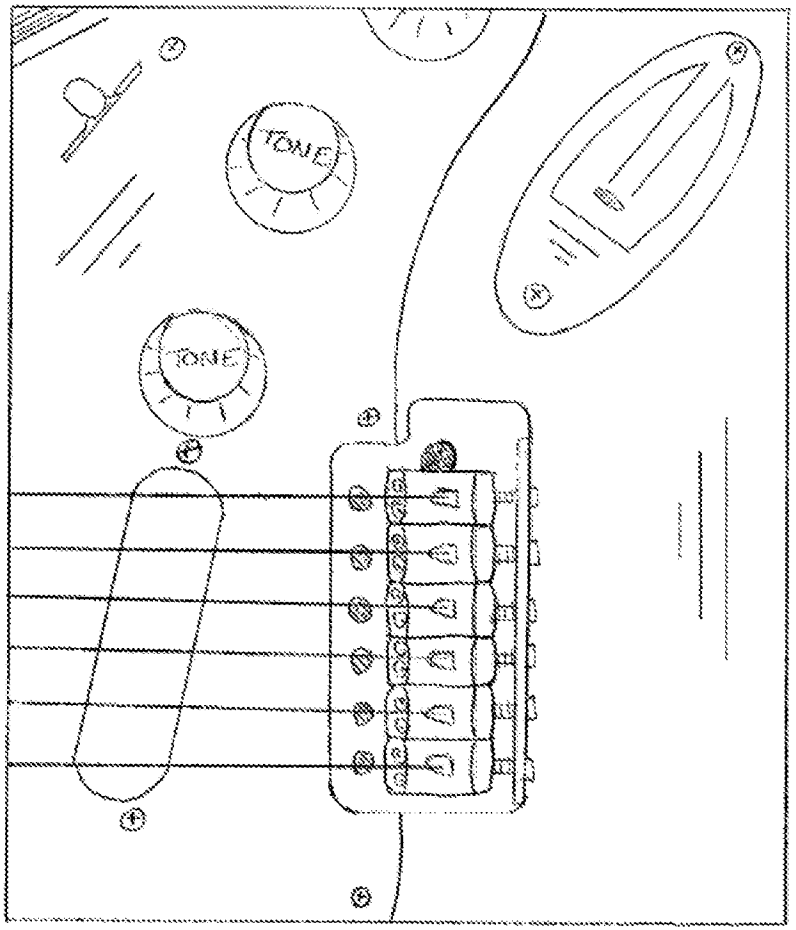
Figure 1 Prior Art
FIG. 1 is a top view of a prior art embodiment of a tremolo bridge mounted on a guitar.
Figure 2:
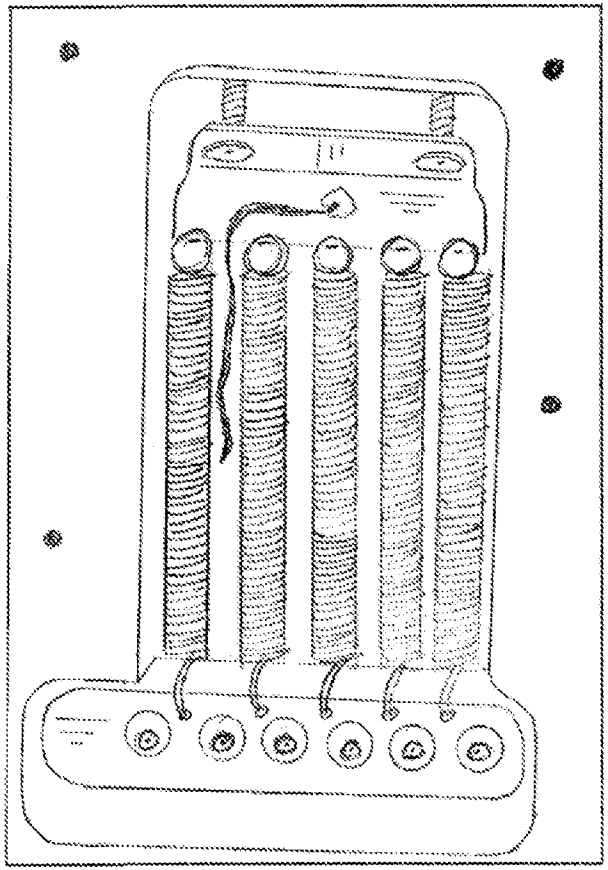
Figure 2 Prior Art
FIG. 2 is bottom view of a prior art embodiment of the tremolo bridge mounted on a guitar.
Figure 3:
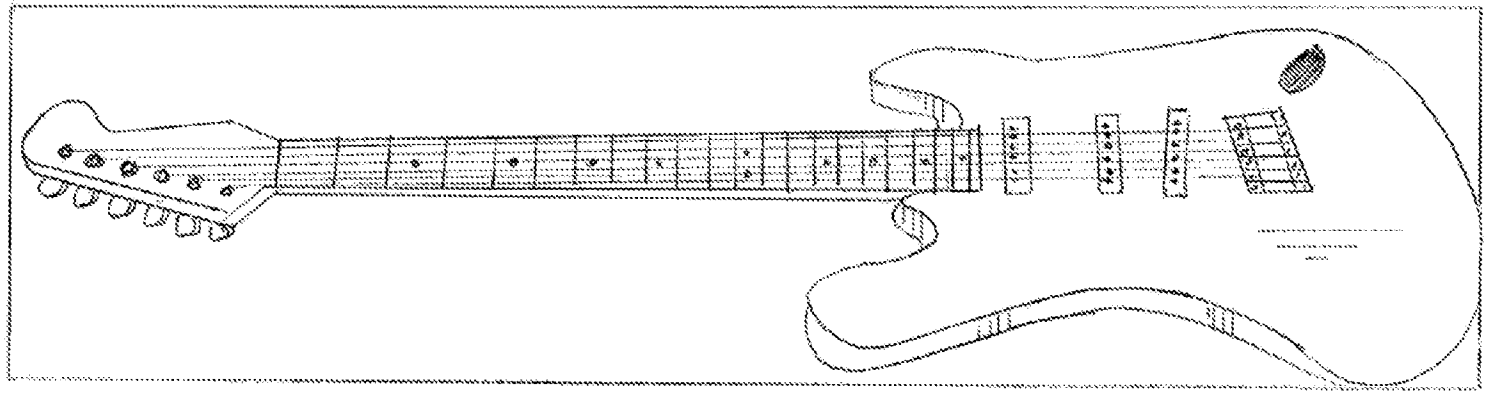
Figure 3 Prior Art
FIG. 3 is a top perspective view of a prior art embodiment of a guitar with a tremolo bridge.
Figure 4:
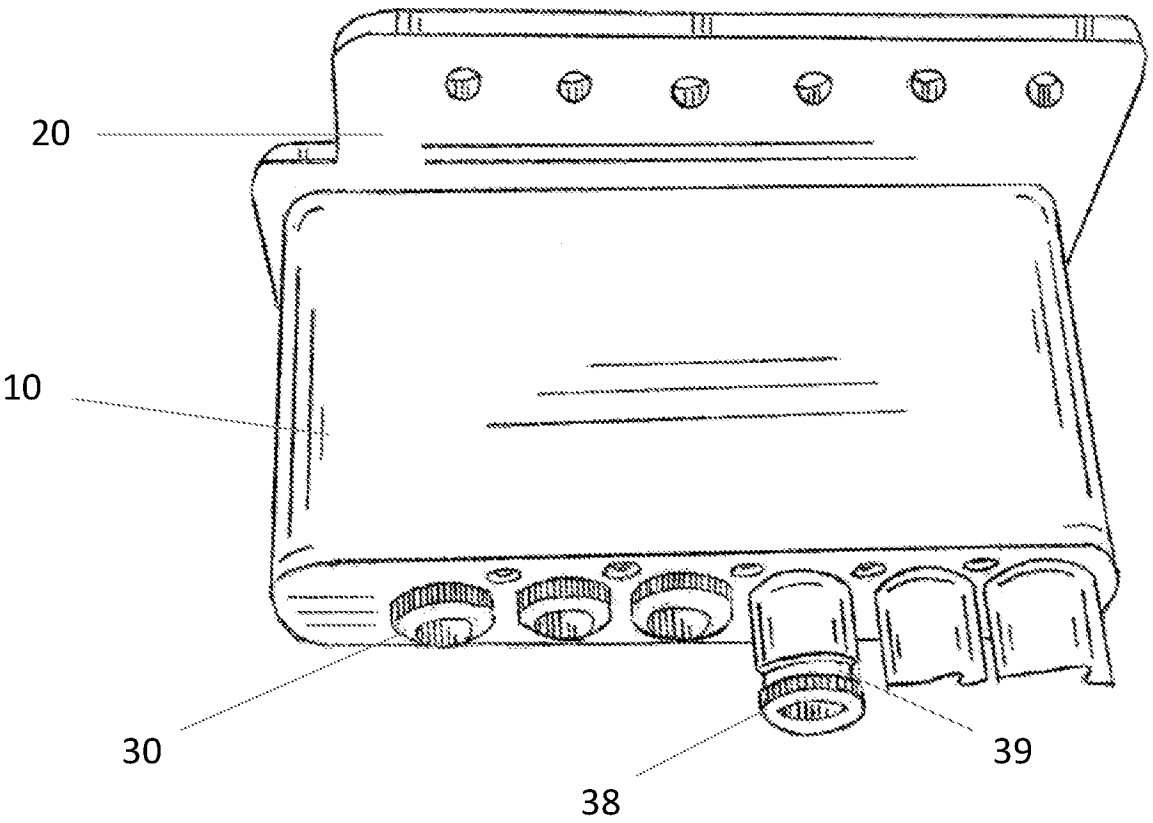
FIG. 4 is a bottom perspective view of the tremolo block with string cartridges and block plate.
Figure 6:
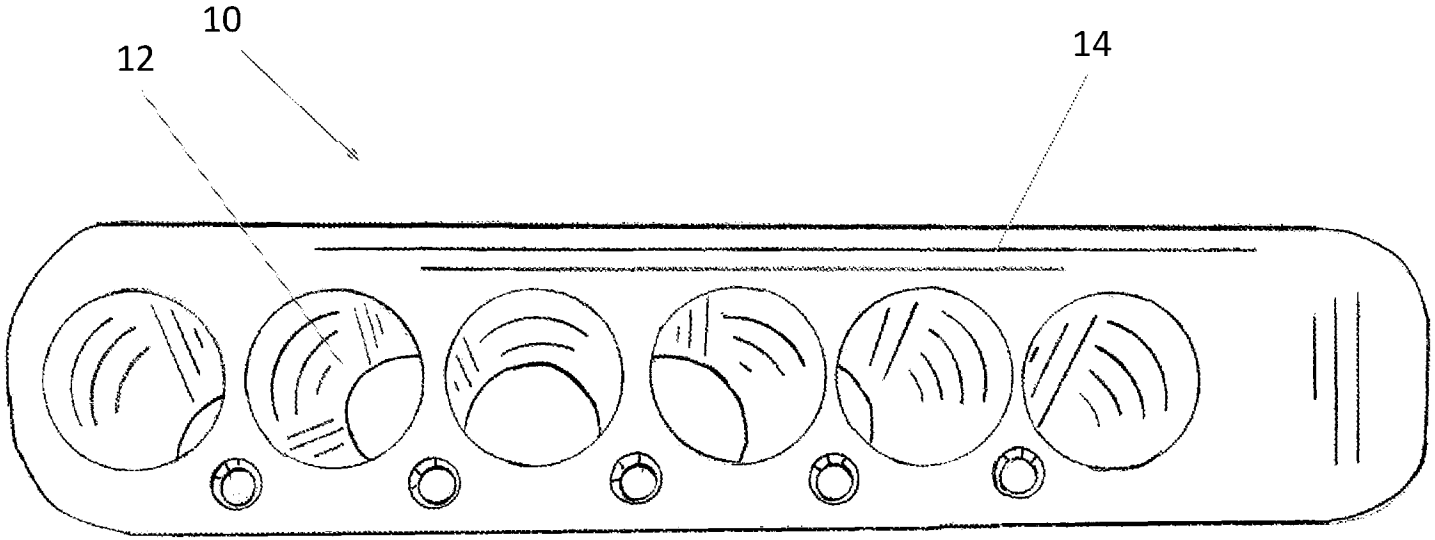
FIG. 6 is a bottom perspective view of the tremolo block.

As shown in FIGS. 6 and 4, the tremolo block 10 has a block body 14 and at least one cartridge mounting bore 12 therethrough. The block body 14 is sized to enclose the at least one cartridge mounting bore 12. In a preferred embodiment, the tremolo block is 1 and ⅝ inches high, ⅝ inches wide and 3 inches deep. The tremolo block can have from about 2 to 10 mounting bores 12. In a preferred embodiment, the tremolo block has 6 mounting bores. The cartridge mounting bore preferably is cylindrical, with a round cross-section, but alternatively can have square, rectangular, polygonal or oval cross-sections.

Figure 7:
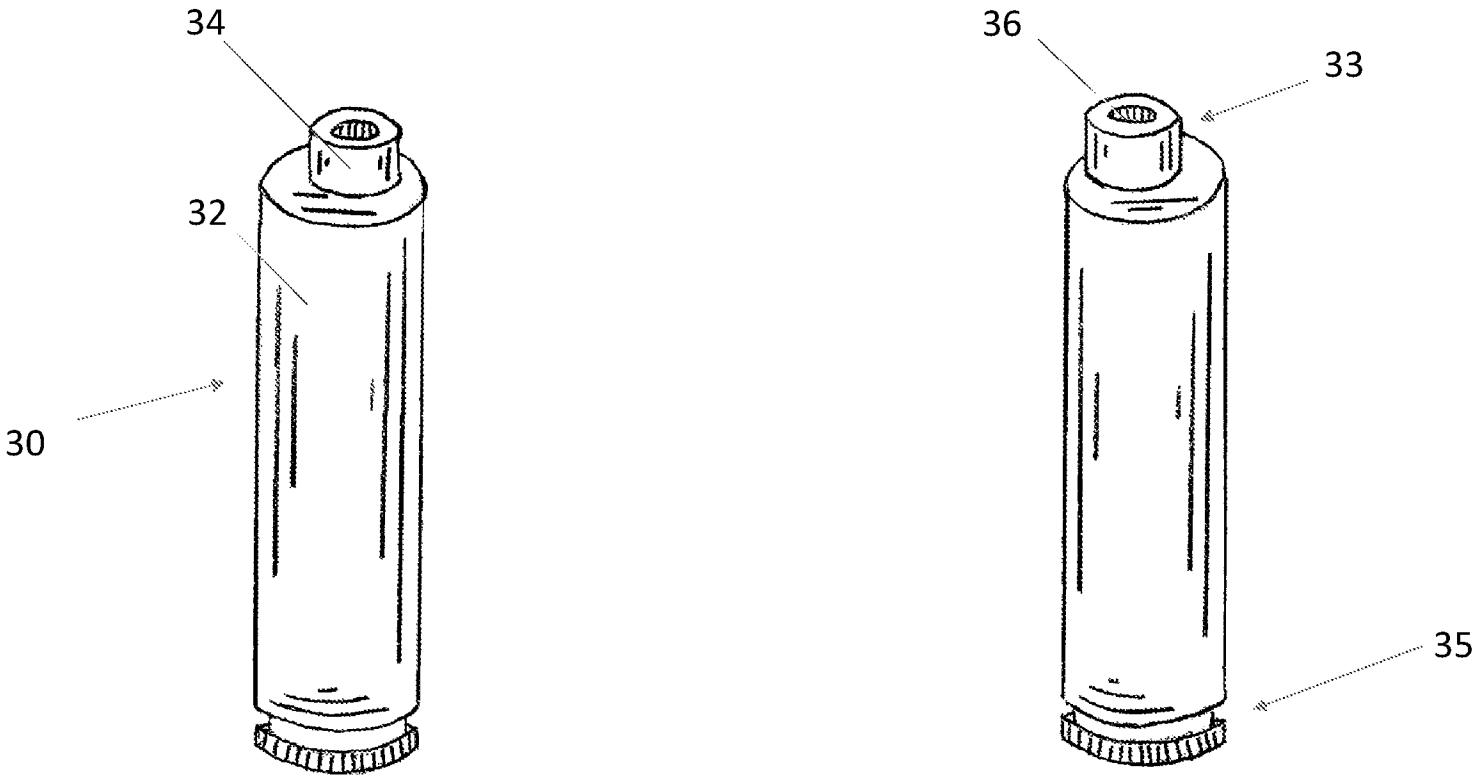
FIG. 7 is a top perspective view of the string cartridges.
Figure 9:
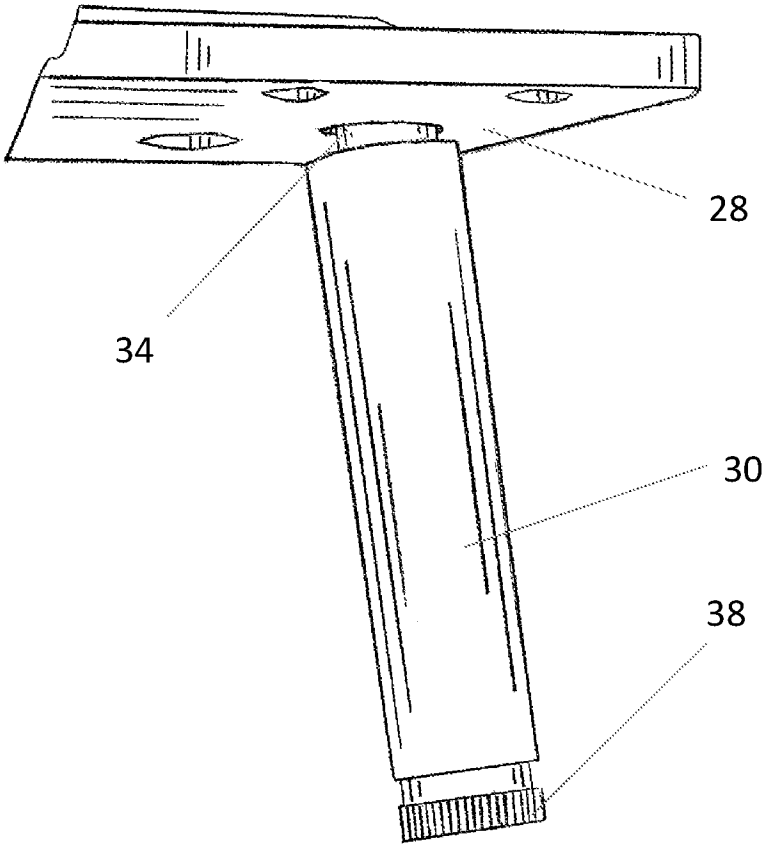
FIG. 9 is a side view of the string cartridge and block plate.
Figure 10:
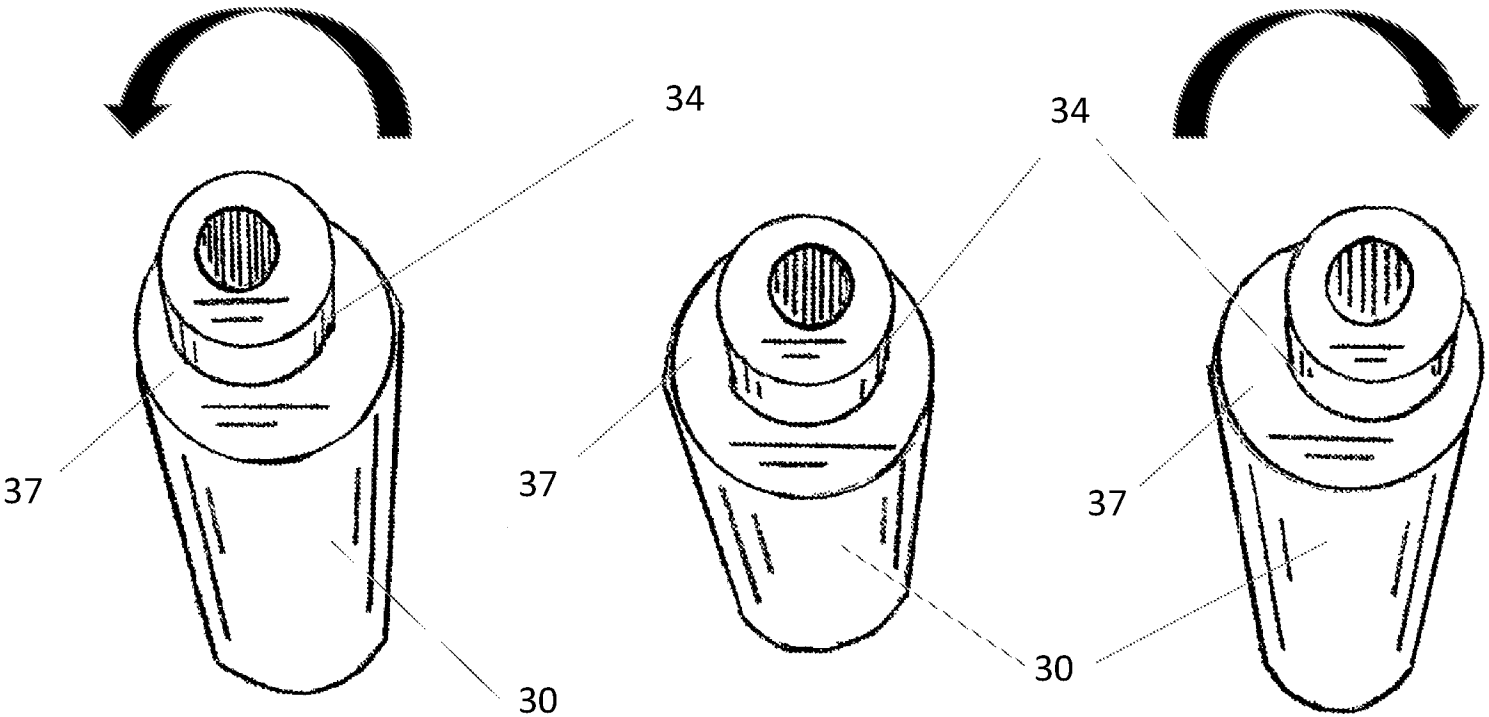
FIG. 10 is a top perspective view of the string cartridge.

As shown in FIGS. 7, 9 and 10, the string cartridge 30 has a cartridge body 32 and a string bore 36 therethrough. In a preferred embodiment the string cartridge is cylindrical in shape, with a round cross-section, but alternatively, the cross-section can be square, rectangular, polygonal or oval shaped. The shape of the cartridge body 32 is designed to be inserted into and engage releasably with the cartridge mounting bore 12, so both must have about the same size and cross-section. A preferred shape is a cylinder so that the cartridge body 32 can rotate when inserted into the cartridge mounting bore.

In a preferred embodiment, the string cartridge has a first end 33 with a flat portion 37 and an offset boss 34. The boss 34 projects upward from the flat portion 37 to friction fit in a cartridge plate bore 22 of block plate 20. In a preferred embodiment, the string cartridge has a second end 35 with a ribbed gripping portion 38 which is defined by a groove 39. As shown in FIG. 10, the string bore 36 and the offset boss 34 are not centered in the cartridge body 32, but are off-center. This allows, by rotating the cartridge body, to vary the string spacing. The rotating string cartridge allows the manufacture of one tremolo block that can be used with a variety of sizes of bridges. Tremolo blocks without the option of changing string spacing have to be custom manufactured for each bridge size.

Figure 11:
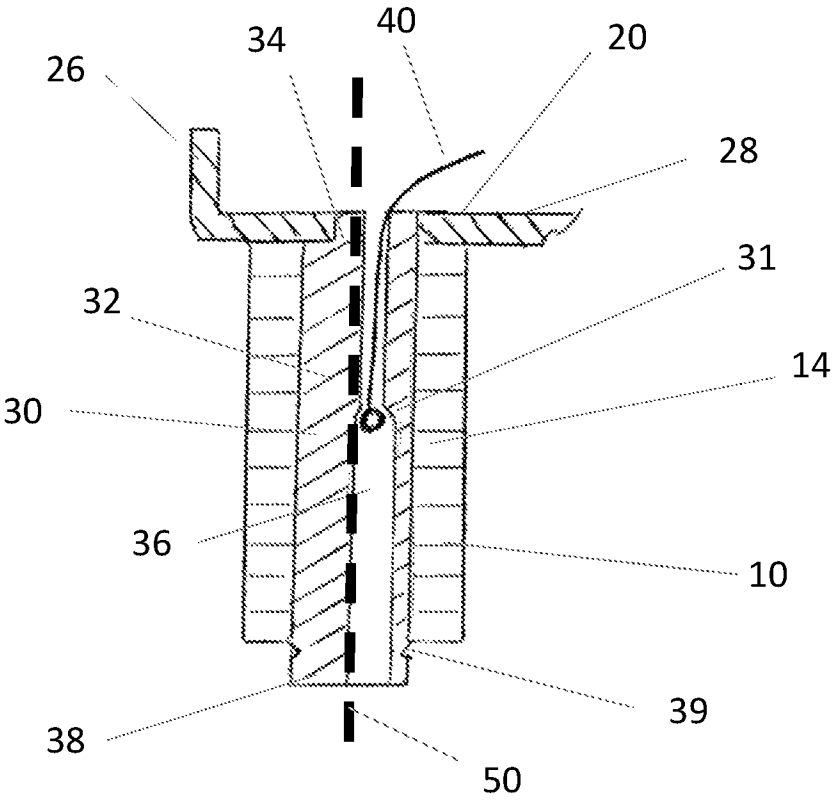
FIG. 11 is cut-away view of the tremolo block, block plate, string cartridge and guitar string assembled.

As shown in FIG. 11, in a preferred embodiment, the string bore 36 has a stepped portion 31, with a wider portion at the bottom and a narrower portion at the top. This works to secure the end of the guitar string 40 by acting as a stop for the mounting peg at the end of the string.

As further shown in FIGS. 11 and 4, because of the offset boss 34, the guitar string never contacts the tremolo block 10 or the block plate 20. This limits the wear and tear on the tremolo block and the block plate caused by friction from the guitar string as it is played. If the string cartridge is damaged, only that part can be removed and replaced. As shown in FIG. 11, the string bore 36 is off-center to the longitudinal axis 50 of the cartridge body 32 and passes through the cartridge body parallel to the longitudinal axis.

Figure 5:
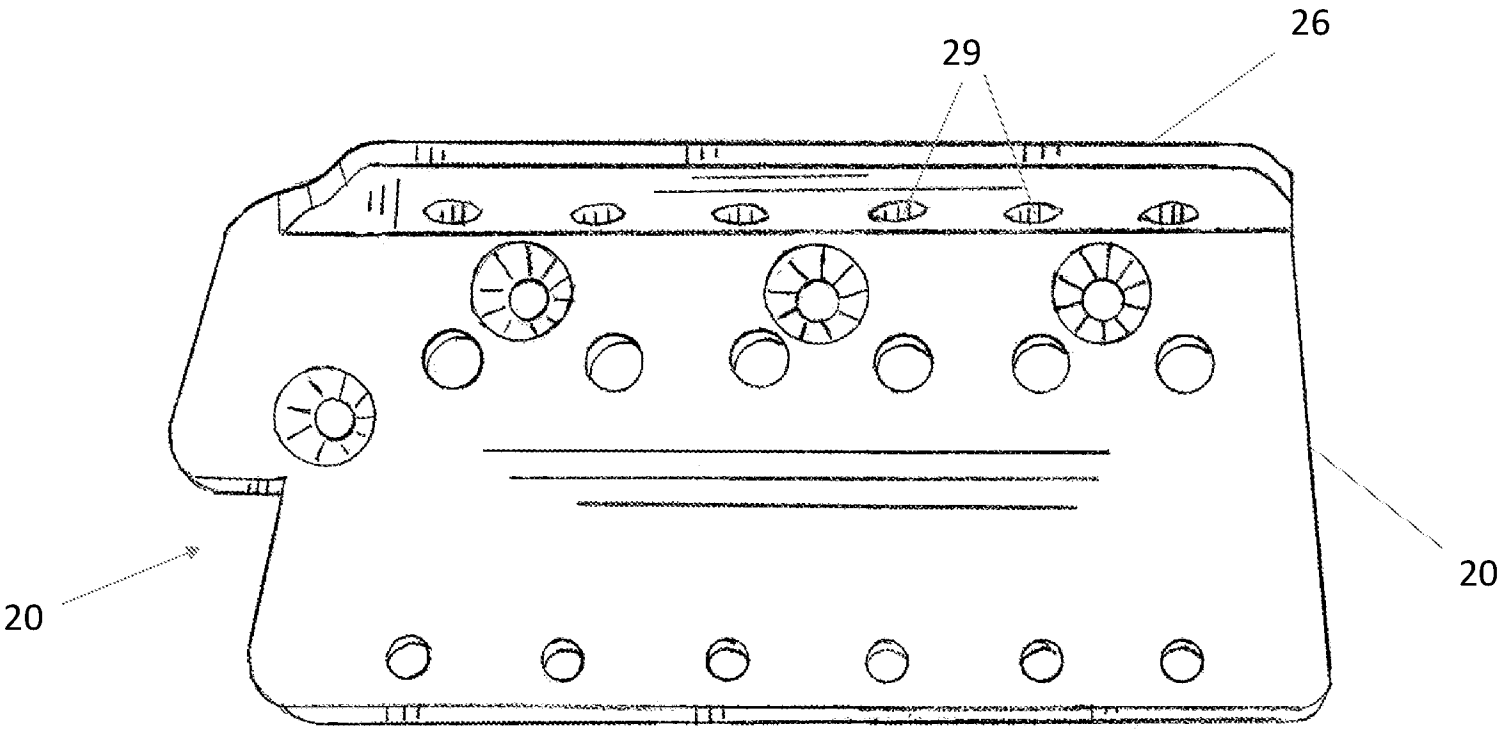
FIG. 5 is a top perspective view of the block plate.
Figure 8:
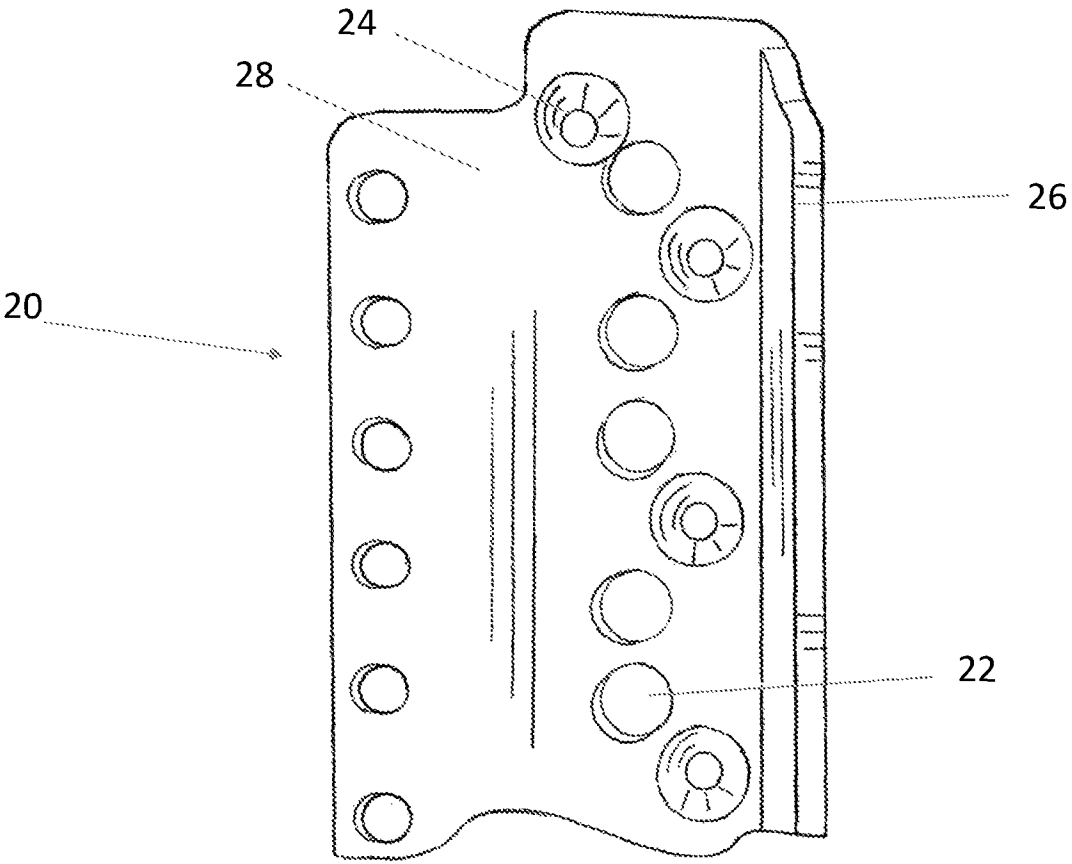
FIG. 8 is a top view of the block plate.

As shown in FIGS. 5 and 8, the block plate 20 has a horizontal surface 28 and a vertical wall 26. Preferably, the plate has from 2 to 6 plate mounting bores 24 to mount the plate in the guitar. The plate has from about 2 to 10 cartridge plate bores 22 for engaging with the offset bosses 34 of the string cartridges 30. In a preferred embodiment, the plate has from 2 to 10 bores for mounting saddle blocks 29.

In another preferred embodiment, the string cartridge is made of brass, steel, copper, zinc, aluminum and various alloys. In a most preferred embodiment, the string cartridge is made from steel. When multiple string cartridges are used, they may all be made of the same metal, or different metals to provide different tones.

In a preferred embodiment the stringed instrument is a guitar, bass guitar, mandolin or banjo.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A string cartridge comprising a cartridge body and a string bore therethrough;

wherein the cartridge body consists of a cylinder having a first end and a second end;

wherein the first end has a flat portion and a cylindrical boss;

wherein the boss projects upward from the flat portion;

wherein the cartridge body has a longitudinal axis;

wherein the string bore consists of an opening parallel to the longitudinal axis and off-center to the longitudinal axis;

wherein the string bore is enclosed by the cylinder and passes through the first end and the second end; and wherein the boss is aligned with the string bore, and the string bore passes through the boss.

2. The string cartridge of claim 1, wherein the string cartridge is made of metal selected from the group consisting of brass, steel, copper, zinc and aluminum.

3. The string cartridge of claim 2, wherein the string bore has a stepped portion to secure a mounting peg of a guitar string, wherein the stepped portion consists of a wider portion at the bottom and a narrower portion at the top.

4. The string cartridge of claim 1, wherein the second end has a grip.

5. A tremolo device comprising at least one string cartridge and a tremolo block;

wherein the string cartridge comprises a cartridge body and a string bore therethrough;

wherein the cartridge body consists of a cylinder having a first end and a second end;

wherein the first end has a flat portion and a cylindrical boss;

wherein the boss projects upward from the flat portion;

wherein the cartridge body has a longitudinal axis;

wherein the string bore consists of an opening parallel to the longitudinal axis and off-center to the longitudinal axis;

wherein the string bore is enclosed by the cylinder and passes through the first end and the second end; and wherein the boss is aligned with the string bore, and the string bore passes through the boss wherein the tremolo block comprises a block body with at least one cartridge mounting bore therethrough; and wherein the string cartridge is removeably engaged with the cartridge mounting bore.

6. The tremolo device of claim 5, wherein the string cartridge and the tremolo block are made from metal selected from the group consisting of brass, steel, copper, zinc and aluminum.

7. The tremolo device of claim 6, further comprising a block plate in contact with the tremolo block, wherein the boss of the string cartridge engages removeably with the block plate.

8. A tremolo device comprising at least one string cartridge, a tremolo block and a block plate, wherein the cartridge has a cartridge body and a string bore therethrough;

wherein the cartridge body consists of a cylinder having a first end and a second end;

wherein the first end has a flat portion and a cylindrical boss;

wherein the boss projects upward from the flat portion;

wherein the cartridge body has a longitudinal axis;

wherein the string bore consists of an opening parallel to the longitudinal axis and off-center to the longitudinal axis;

wherein the string bore is enclosed by the cylinder and passes through the first end and the second end; and wherein the boss is aligned with the string bore, and the string bore passes through the boss;

wherein the tremolo block has a block body and at least one cartridge mounting bore therethrough;

wherein the block plate has a horizontal surface and a vertical wall;

wherein the horizontal surface of the block plate rests on the tremolo block; and wherein the string cartridge engages removeably with the cartridge mounting bore.

9. The tremolo device of claim 8, wherein the string cartridge and the tremolo block are made from metal selected from the group consisting of brass, steel, copper, zinc and aluminum.

10. The tremolo device of claim 9, wherein the boss of the string cartridge engages removeably with the block plate.

* * * * *